US008796941B2

(12) United States Patent
Krummel et al.

(10) Patent No.: US 8,796,941 B2
(45) Date of Patent: Aug. 5, 2014

(54) METHOD AND CIRCUIT ARRANGEMENT FOR OPERATING AT LEAST ONE DISCHARGE LAMP

(75) Inventors: Peter Krummel, Traunreut (DE); Andreas Mitze, Traunreut (DE)

(73) Assignee: OSRAM Gesellschaft mit Beschraenkter Haftung, Munich (DE)

( * ) Notice: Subject to any disclaimer, the term of this patent is extended or adjusted under 35 U.S.C. 154(b) by 708 days.

(21) Appl. No.: 12/989,421

(22) PCT Filed: Apr. 25, 2008

(86) PCT No.: PCT/EP2008/055074

§ 371 (c)(1),
(2), (4) Date: Oct. 25, 2010

(87) PCT Pub. No.: WO2009/129860

PCT Pub. Date: Oct. 29, 2009

(65) Prior Publication Data

US 2011/0037393 A1 Feb. 17, 2011

(51) Int. Cl.
*H05B 37/02* (2006.01)
*H05B 41/295* (2006.01)

(52) U.S. Cl.
CPC ..... *H05B 41/295* (2013.01)
USPC ..... 315/219; 315/309; 315/105; 363/21.12; 363/21.16

(58) Field of Classification Search
CPC ..... H05B 41/295; H05B 41/288
USPC ..... 315/209 R, 224, 225, 291, 309, 310, 315/311, 274, 276, 46, 48, 49, 50, 105, 106, 315/108, 117, 118, 219, 307, 119, 74, 88; 363/16, 21.12, 21.16
See application file for complete search history.

(56) References Cited

U.S. PATENT DOCUMENTS 6,525,479 B1 * 2/2003 Keggenhoff et al. ..... 315/88
6,972,531 B2 12/2005 Krummel (Continued)

FOREIGN PATENT DOCUMENTS

DE 19850441 A1 5/2000
DE 10345610 A1 5/2005

(Continued)

OTHER PUBLICATIONS

English language abstract for DE 10 2005 006 716 A1, (Oct. 28, 2010).
International Search Report of PCT/EP2008/055074, (Jul. 16, 2009).

*Primary Examiner* — Douglas W Owens
*Assistant Examiner* — Borna Alaeddini

(57) ABSTRACT

A method for operating a lamp, wherein in the preheating phase a first value of the voltage drop correlated with the reciprocal of the electrical resistance of a coil of the lamp is determined across a resistor at a first instant, and a second value of the voltage drop is determined at a second instant, may include: a) determining the difference between a first and the second value; b) b1) if the difference is greater than a first threshold value: carrying out an algorithm for lamp-type recognition; b2) if the difference is not greater than the first threshold value: c1) if the difference is greater than a second threshold value: d1) if the second value is greater than a third threshold value: determining a coil short circuit; d2) if the second value is not greater than the third threshold value: operating the lamp with the current set of operating parameters.

7 Claims, 4 Drawing Sheets

(56) References Cited

U.S. PATENT DOCUMENTS

| | | | | |
|---|---|---|---|---|
| 7,432,662 | B2 * | 10/2008 | Busse | 315/209 T |
| 2009/0160366 | A1 | 6/2009 | Grabner | |
| 2011/0037393 | A1 * | 2/2011 | Krummel et al. | 315/119 |

FOREIGN PATENT DOCUMENTS

| | | | |
|---|---|---|---|
| DE | 102005006716 | A1 | 2/2006 |
| DE | 102005046482 | A1 | 3/2007 |

* cited by examiner

METHOD AND CIRCUIT ARRANGEMENT FOR OPERATING AT LEAST ONE DISCHARGE LAMP

RELATED APPLICATIONS

The present application is a national stage entry according to 35 U.S.C. §371 of PCT application No.: PCT/EP2008/055074 filed on Apr. 25, 2008.

TECHNICAL FIELD

Various embodiments relate to a method for operating at least one discharge lamp in a circuit arrangement having an input with a first and a second input connection for connecting a DC supply voltage, an output with at least a first and a second output connection for connecting the at least one discharge lamp, an inverter with at least a first and a second electronic switch that are coupled in series between the first and the second input connection, wherein a midpoint of the inverter is formed between the first and the second switch, an ignition device that includes a lamp inductor and a resonant capacitor, a preheating device that includes the series connection of a primary inductor, a third electronic switch and a current measurement resistor that is coupled between the midpoint of the inverter and the second input connection, and a first and a second secondary inductor coupled to the primary winding, wherein the first secondary inductor is coupled to the first output connection and the second secondary inductor is coupled to the second output connection, a control device that is coupled to the current measurement resistor in which at least two sets of operating parameters assigned to different types of discharge lamps are stored, wherein one set of operating parameters constitutes a current set of operating parameters, wherein the control device is designed to actuate at least the first, the second and the third electronic switch in accordance with the current set of operating parameters, wherein in the preheating phase a first value of the voltage drop correlated with the reciprocal of the electrical resistance of at least one coil of the at least one discharge lamp is determined across the current measurement resistor at a first instant, and a second value of the voltage drop correlated with the reciprocal of the electrical resistance of the at least one coil of the at least one discharge lamp is determined across the current measurement resistor at a second instant, wherein the second instant is after the first instant. Furthermore, various embodiments relate to a corresponding circuit arrangement for operating at least one discharge lamp.

BACKGROUND

Such a circuit arrangement is disclosed in DE 103 45 610 A1 and is illustrated in FIG. 1 for the purpose of easing comprehension. Said figure shows a circuit arrangement with two field effect transistors T1, T2 that are arranged in the manner of a half bridge inverter. The two field effect transistors receive their control signal from a microcontroller MC. An intermediate circuit capacitor C1 with a comparatively large capacitance is arranged in parallel with the DC input voltage of the half bridge inverter T1, T2. The intermediate circuit capacitor C1 serves as DC voltage source and provides the so-called intermediate circuit voltage $U_{Zw}$ for the half bridge inverter. The intermediate circuit voltage $U_{Zw}$ is usually approximately 400 V and is generated on the AC voltage by means of a system voltage rectifier (not illustrated) and of a boost converter (not illustrated). The intermediate circuit capacitor C1 is arranged in parallel with the voltage output of the boost converter. Connected to the output M of the half bridge inverter is a load circuit that is designed as a series resonant circuit and consists essentially of the lamp inductor L1 and the ignition capacitor C2. Connected in parallel with the ignition capacitor C2 are the discharge paths of the fluorescent lamp LP and the capacitor C3, which is charged up to half the supply voltage of the half bridge inverter during operation of the lamp in the steady state of the half bridge inverter. The lamp electrodes E1, E2 of the fluorescent lamp LP are designed as electrode coils each having two electrical connections. Connected in parallel with the electrode coils E1, E2 in each case is a secondary winding SI1, SI2 of a transformer that serves the inductive heating of electrode coils E1, E2. The primary winding P1 of this transformer is connected in series with the switching path of a further field effect transistor T3 to whose control electrode the microcontroller MC likewise applies control signals, and a measurement resistor R1, during dropping across the measurement resistor R1 is a voltage Res that is correlated with the reciprocal of the electrical resistance of a coil E1, E2 of the discharge lamp LP. The series connection of the components P1, T3 and R1 is connected to the output M of the half bridge inverter. A first connection of the primary winding P1 is connected to the output or the center tap M of the half bridge inverter and to the lamp inductor L1, while the second connection of the primary winding P1 is connected to the field effect transistor T3 and, in the DC forward direction via a diode D1 to the connection (+) at a high potential, of the intermediate circuit capacitor C1. A first connection of the measurement resistor R1 is connected to frame potential (−), while the second connection of the measurement resistor is connected to the field effect transistor T3 and, via a low pass filter R2, C4, to the voltage input A of the microcontroller MC.

By means of the coupling capacitor C3 charged up to half the supply voltage of the half bridge inverter, and of the alternately switching transistors T1, T2 of the half bridge inverter, a high frequency AC voltage is applied to the load circuit L1, C2, LP in a known way, its frequency being determined by the switching cycle of the transistors T1, T2, and is in the range of approximately 50 kHz to approximately 150 kHz. Before the ignition of the gas discharge in the fluorescent lamp LB, a heating current is applied to the lamp electrodes E1, E2 thereof by means of the transformer P1, SI1, SI2 in an inductive fashion. For this purpose, the transistor T3 is switched on and off by the microcontroller MC in a fashion synchronous with the transistor T1. In the course of the switched-on duration of the transistors T1, T3, a current therefore flows through the primary winding P1 and the measurement resistor R1. In the course of the switched off duration of the transistors T1, T3, the flow of current through the measurement resistor R1 is interrupted. The energy stored in the magnetic field of the primary winding P1 is fed to the intermediate circuit capacitor C1 via the diode D1 in the course of the switched-off duration of the transistors T1, T3 and the switched-on duration of the transistor T2. Owing to the alternately switching transistors T1, T2 and to the transistor T3 switching synchronously with the transistor T1, a high frequency current flows through the primary winding P1 and induces corresponding heating currents for the electrode coils E1, E2 in the secondary windings SI1, SI2. The voltage drop across the measurement resistor R1 over a time interval of a plurality of switching cycles of the transistor T3 is averaged with the aid of the low pass filter R2, C4 and fed to the voltage input A of the microcontroller MC. The input voltage at the connection A of the microcontroller MC is converted by means of an analog-to-digital converter into a digital signal and evaluated in the microcontroller MC.

The microcontroller MC detects the voltage drop across the capacitor C4 for the first time after approximately 30 ms after the beginning of the heating phase, and for the second time approximately 600 ms after the beginning of the heating phase. If the absolute value of the difference between the two voltage values exceeds a prescribed threshold value, the voltage value at the end of the heating phase is compared with a reference value stored in the microcontroller MC and used for the lamp-type recognition. As already mentioned, in this case the voltage value is correlated with the reciprocal of the coil resistance. If the absolute value of the difference between the two voltage values is less than the threshold value, the lamp continues to be operated with the current data set, that is to say no lamp-type recognition is carried out. The latter is the case in accordance with the publication named when the electrode coils E1, E2 have not yet been entirely cooled at the beginning of the heating phase owing to the last lamp operation, or when the circuit arrangement is operated with an ohmic dummy resistance instead of the electrode coils E1 and E2 of the fluorescent lamp LP.

In accordance with a further prior art, which is used by the applicant in circuit arrangements already marketed, a further evaluation of the measured coil resistances such as is illustrated in conjunction with FIG. 2 is undertaken on the basis of the prior art in accordance with DE 103 45 610 A1. The aim of this procedure is to detect one or more coil short circuits owing to instances of incorrect wiring of the luminaires in the case of electronic circuit arrangements. The aim of this approach is to avoid instants of coil darkening or the occurrence of damage to the circuit arrangement during operation.

The known method starts in step 100. Subsequently, a check is made in step 110 as to whether the intermediate circuit voltage $U_{Zw}$ has reached its desired value $U_{Zwsoll}$. If this is not the case, the intermediate circuit voltage $U_{Zw}$ is increased in step 120. If it is determined in step 110 that the intermediate circuit voltage $U_{Zw}$ has reached its desired value $U_{Zwsoll}$, a first value Res1new of the voltage drop at the measurement resistor R1 that is correlated with the coil resistance of a coil of the fluorescent lamp LP is determined in step 130 at a first instant $t_1$, and a second value Res2new of this voltage drop is determined at a second instant $t_2$. In step 140, the difference (Res1new−Res2new) is compared with a first threshold value S1. If the difference is greater than the threshold value, an algorithm for lamp-type recognition is carried out. Said algorithm comprises the steps 150 to 230. In this process, the absolute value $$\left|\frac{Res2new}{Res2old}-1\right|$$

is firstly compared in step 150 with a threshold value X1, Res2new constituting the currently measured value of the voltage drop across the measurement resistor R1, and Res2old the value of the preceding measurement. If the absolute value $$\left|\frac{Res2new}{Res2old}-1\right|$$

is less than the threshold X1, the lamp is operated in step 160 with the current set of operating parameters. The new value Res2new differs only very slightly from the old value Res2old, and so there is no doubt that the same lamp is connected to the circuit arrangement. Consequently, said lamp can be operated without change in step 160 with the aid of the current data set. If, by contrast, the value $$\left|\frac{Res2new}{Res2old}-1\right|$$

is greater than the threshold X1, it is determined in step 170 whether the value $$\left|\frac{Res2new}{Res2old}-1\right|$$

lies between the threshold X1 and a threshold X2, X2 being greater than X1. If this is affirmed, it is assumed that the same lamp is continued to be referred to, but has only aged a little. Consequently, the new value Res2new is overwritten on the old value Res2old in step 180. Thereafter, the lamp continues to be operated with the aid of a current data set in step 190.

If, by contrast, it is determined in step 170 that the value $$\left|\frac{Res2new}{Res2old}-1\right|$$

does not lie between X1 and X2, the value of Res2new is looked up in a table in order to derive therefrom the lamp type to which this Res2new is assigned. If the corresponding lamp data set is recognized in step 200 in this case, the lamp is operated in step 210 with the aid of the detected lamp data set i. Res2new is overwritten on Res2old in step 220. If no lamp data set for Res2new is found in step 200, the lamp is operated with a default data set in step 230.

If it is determined in step 140 that the difference between Res1new and Res2new is below the threshold value S1, a check is made in step 240 as to whether the difference (Res1new−Res2new) lies below a second threshold value S2 that is less than the threshold value S1. If this is the case, a dummy coil is assumed in step 250, or a coil short circuit. If a dummy coil can be excluded (it being the case that a lamp is used), a coil short circuit is therefore present and the circuit arrangement is switched off. If it is determined in step 240 that the difference between Res1new and Res2new is greater than the threshold S2, the lamp continues to be operated in step 260 with the current data set.

It has now been determined that damage to the circuit arrangement occurs repeatedly in the case of the procedure outlined when the plurality of the luminaires are operated simultaneously in a single circuit arrangement.

SUMMARY

Various embodiments develop the method initially mentioned or the circuit arrangement initially mentioned so as to enable a reliable operation of a plurality of luminaires in a circuit arrangement.

The present invention is based on the finding that damage to the circuit arrangements occurs in the case of the procedure according to the prior art because although said procedure can recognize coil short circuits in the case of short lines, it cannot do so in the case of long lines such as occur in the operation of a plurality of luminaires with the aid of one circuit arrangement. Coil short circuits in the case of long lines are distinguished by the fact that the difference between the first measured value of the voltage drop across the measurement resistor and the second measured value of the voltage drop across the measurement resistor is greater than in the case of a coil short circuit given short lines.

If the threshold S2 is now raised in step 240 in order to detect coil short circuits giving long lines, in the case of a lamp whose coils were not yet completely cooled owing to a previous operation, this would lead to an erroneous detection of a coil short circuit, and to switching the circuit arrangement off erroneously, and therefore undesirably. Consequently, it is provided according to the invention in a development of the prior art that after determination that the difference (Res1new−Res2new) is greater than the threshold value S2 there is a need for further distinction of cases, otherwise, a lamp that has been switched on again would not be operated.

The present invention therefore provides that a further distinction of cases is undertaken when it is determined in step 240 that the difference (Res1new−Res2new) is greater than the threshold value S2: if Res2new is greater than a third threshold value, wherein the third threshold value is less than the first and greater than the second threshold value, a coil short circuit is determined. If, however, Res2new is not greater than the third threshold value, the lamp continues to be operated with the aid of the current set of operating parameters. This measure takes account of the fact that, in the event of renewed switching on, the value Res2new is small in comparison with the value Res2new in the event of a short circuit given longer lines.

By means of this procedure, in the case of relatively long lines coil short circuits are reliably detected whereas lamps that have been switched on again are operated further with the aid of the current data set. This enables two-lamp and multi-lamp devices to be operated with the aid of one circuit arrangement, that is to say with a single ballast, since the relatively long lines resulting in this case can now be monitored reliably for coil short circuits. It follows that damage to the circuit arrangements used in the process is reliably excluded.

A preferred embodiment is distinguished by the fact that it comprises the following further steps: if the difference (Res1new−Res2new) is less than the second threshold value, the following steps are carried out: if the second measured value is between a fourth and a fifth threshold value, wherein the fifth threshold value is less than the fourth threshold value, the lamp-type recognition is disabled. If the second measured value is greater than the fourth threshold value, a coil short circuit is determined. If the second measured value is less than the fifth threshold value, a dummy coil is determined.

The disabling of the lamp-type recognition as it was illustrated in FIG. 2 in conjunction with the steps 150 to 230 enables a lamp manufacturer to ensure the operation of a lamp in use with the aid of a set of parameters that he has prescribed. Thus, a lamp manufacturer can design a luminaire for 50 W, for example, and thereby ensure that even an 80 watt lamp in use is operated merely as a 50 watt lamp. This particularly enables the performance-related elements of the luminaire to be of weaker dimension.

In a further preferred embodiment, it is provided that the lamp-type recognition is enabled upon determination of a coil short circuit given disabled lamp-type recognition. This measure can be used to effect a reenablement, for example by using a dummy coil with a resistance of near zero.

It is preferred to carry out a shutdown after determination of a coil short circuit, that is to say to switch off the circuit arrangement, in order to avoid damage to the circuit arrangement. It is advantageous to generate information relating to the occurrence of a shutdown, thereby facilitating fault location.

Furthermore, it is preferred when the first and/or the second threshold value are/is formed by the product of a factor a and the second value Res2new, wherein $0<a<2$. The first and the second threshold value are thereby dependent on the measured voltage value Res2new. This has proved to be more advantageous in practice than if use were to be made of absolute values at this point. The threshold S1 can, for example, be Res2new (factor a=1), while the threshold S2 can, for example be Res2new/16.

The third threshold value S3 is preferably formed by the product of a factor b with the fourth threshold value S4, where $0<b<1$, wherein the fourth threshold value S4 is greater than the second value Res2new caused by the coil of least resistance, and the fifth threshold value S5 is less than the fourth threshold value.

The preferred embodiments presented with reference to the inventive method, and their advantages are valid correspondingly, to the extent applicable, for the inventive circuit arrangement.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 2:
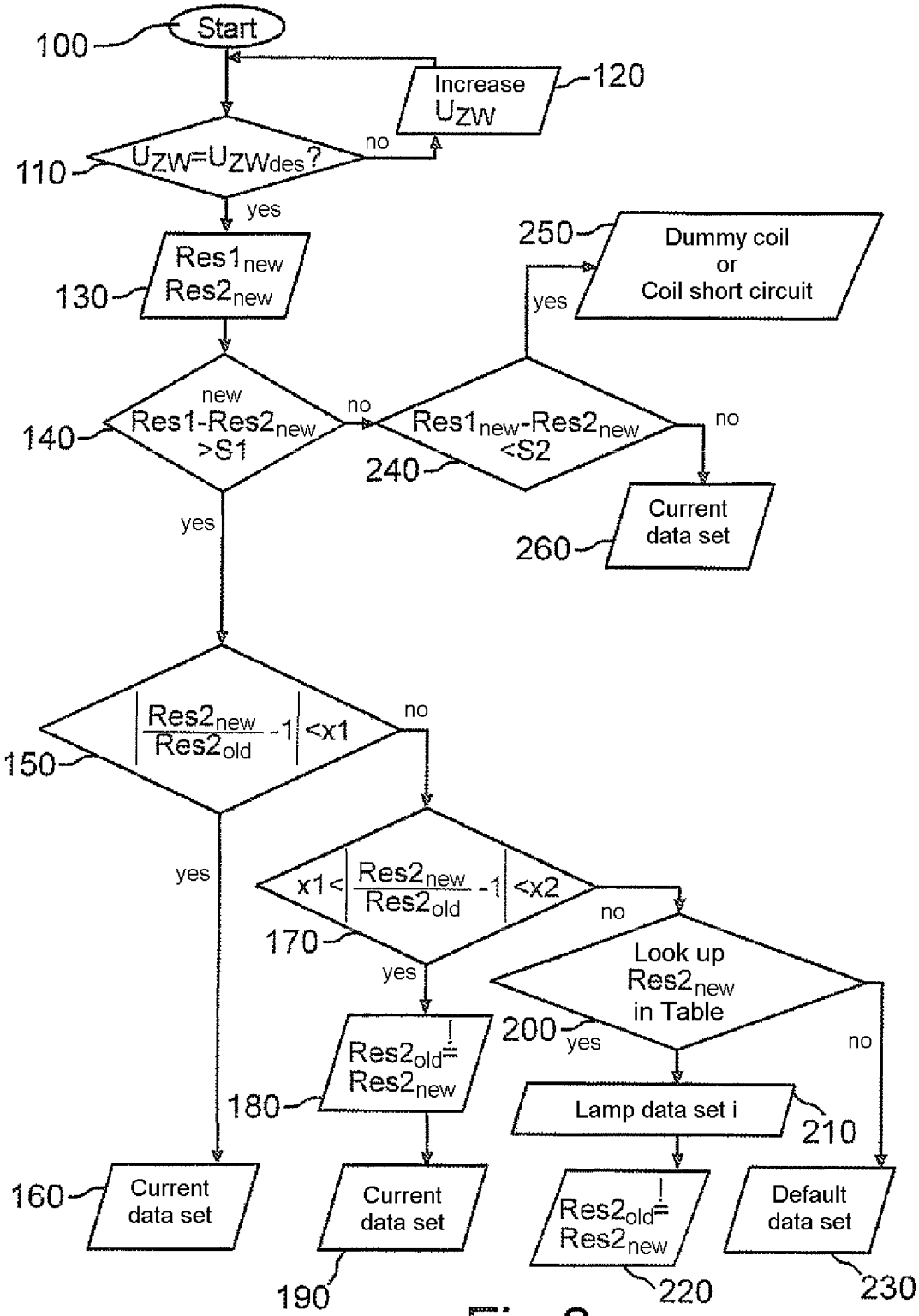
Fig.2 (Prior art)
FIG. 2 shows a flowchart for illustrating a method known from the prior art.

Only the differences from the prior art are examined below. The designs made in conjunction with FIG. 2 therefore are valid to the extent that the flowchart of FIG. 2 corresponds to that of FIG. 3, including also for the inventive method, and are therefore not repeated again.

Figure 3:
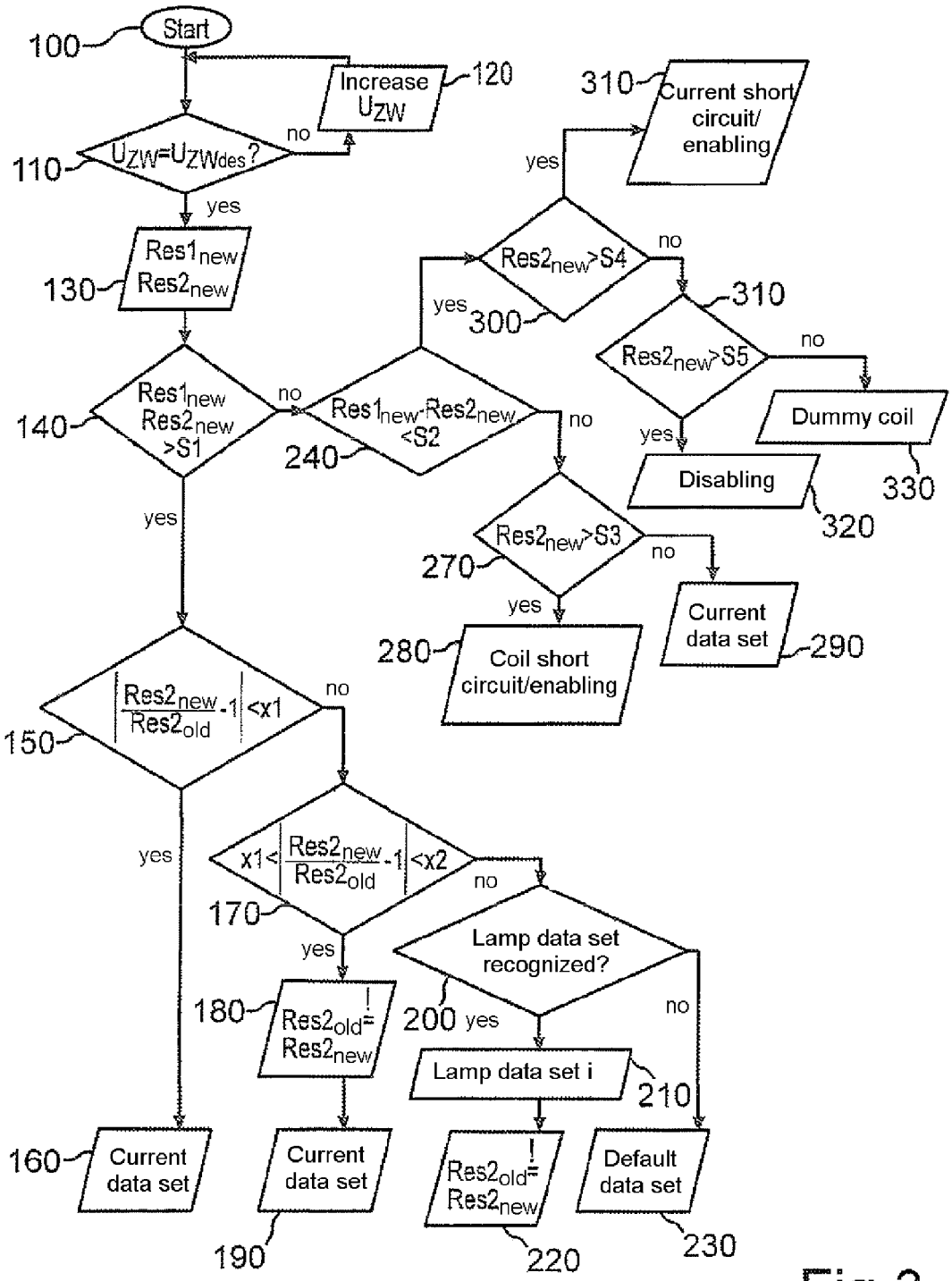
FIG. 3 shows a flowchart for illustrating an embodiment of an inventive method.

In accordance with FIG. 3, when it has been determined in step 240 that the difference (Res1new−Res2new) is greater than a second threshold value S2, wherein the second threshold value is less than the first threshold value S1, a further case distinction is undertaken in step 270: if it is determined in the process that the value Res2new is greater than a third threshold value S3, in step 280 a coil short circuit is determined, or when a disabling of the lamp-type recognition has previously taken place in accordance with steps 150 to 230, said recognition is enabled. If it is determined in step 270 that Res2new is not greater than the third threshold value S3, in step 290 the lamp is therefore operated with the aid of the current set of operating parameters.

If it is determined in step 240 that the difference (Res1new−Res2new) is less than the second threshold value S2, a further case distinction is undertaken in step 300. It is checked in this case whether the value Res2new is greater than a fourth threshold value S4. If this is answered in the affirmative, a coil short circuit is determined in step 310, or if the lamp-type recognition had been disabled in accordance with steps 150 to 230, said recognition is enabled. If it is determined in step 300, however, that the value Res2new is less than the fourth threshold value S4, a further case distinction is undertaken in step 310. It is checked in this case whether Res2new is greater than a fifth threshold value S5, wherein the fifth threshold value is less than the fourth threshold value S4. If this is the case, the lamp-type recognition in accordance with steps 150 to 230 is disabled in step 320. If this is not the case, however, a dummy coil is adopted in step 330.

The following values for the threshold values were selected in a preferred exemplary embodiment: S1=Res2new, S2=1/16 Res2new, S3>S4/4, S4>S5, S4>Res2new caused by the coil of least resistance, X1=6.33 and X2=12.5.

Figure 1:
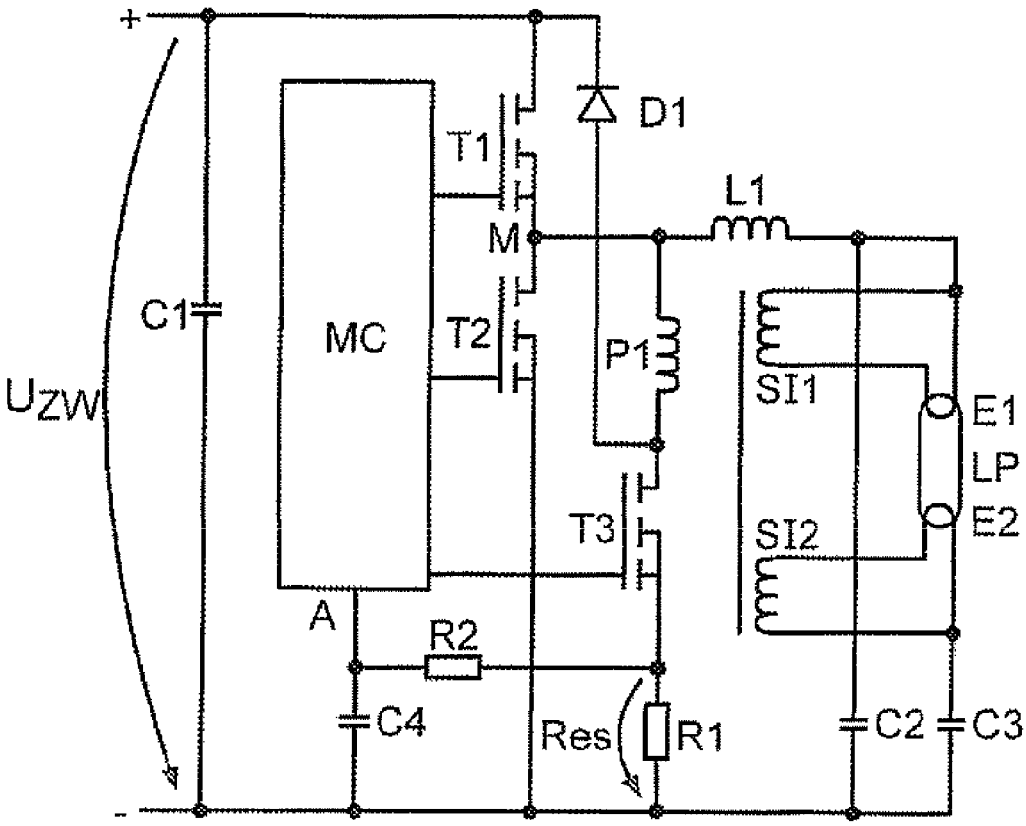
Fig.1 (Prior art)
FIG. 1 is a schematic of a circuit arrangement known from the prior art.

The algorithm of the inventive method is implemented in the microcontroller MC of FIG. 1. This has, in particular, the required storage and comparison devices.

Figure 4:
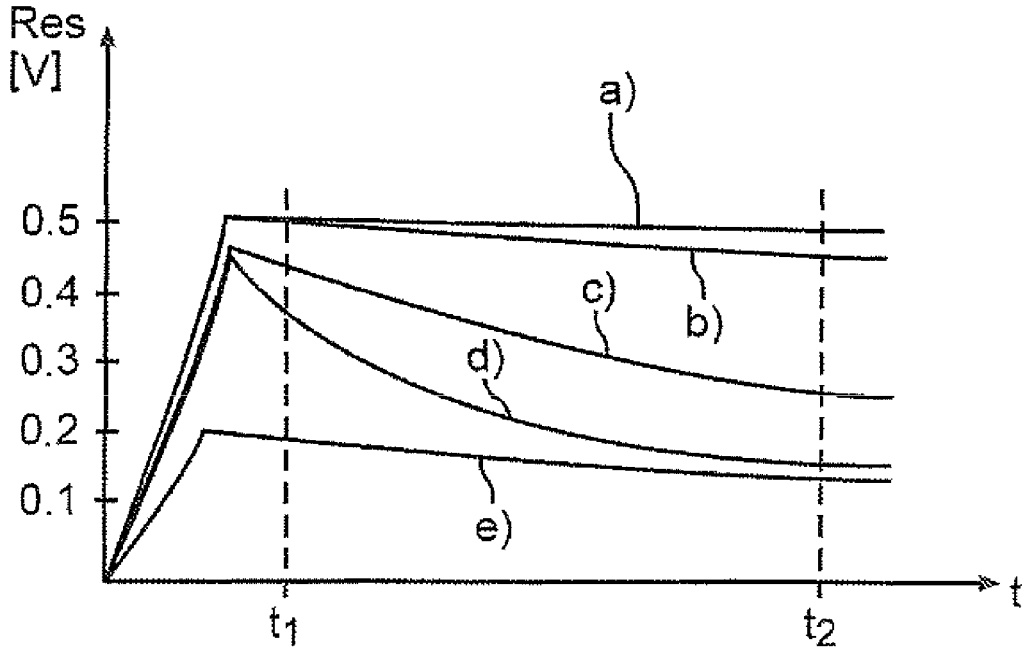
FIG. 4 shows the time profile of the voltage Res, which is correlated with the reciprocal of the coil resistance and drops across the current measurement resistor R1, in different situations.

For the purpose of further comprehension, FIG. 4 shows the time profile of the voltage drop Res, correlated with the reciprocal of the coil resistance, against the current measurement resistor R1 for different situations: curve a) reproduces the time profile in the case of a dummy coil, curve b) does so in the case of a coil short circuit given short lines, curve c) relates to the case of a coil short circuit given relatively long lines, curve d) refers to the case of intact coils, and curve e) relates to switching on again, that is to say the coils had not yet been cooled down from the previous operation.

The present invention enables the detection of a coil short circuit both given short (curve b) and given relatively long lines (curve c). It permits an operation of the fluorescent lamp during switching on in the cooled down state (curve d), and also during switching on in the as yet not cooled down state (curve e). Finally, a dummy coil in use (curve a) continues to be reliably detected.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for operating at least one discharge lamp in a circuit arrangement having an input with a first and a second input connection for connecting a DC supply voltage; an output with at least a first and a second output connection for connecting the at least one discharge lamp; an inverter with at least a first and a second electronic switch that are coupled in series between the first and the second input connection, wherein a midpoint of the inverter is formed between the first and the second switch; an ignition device that comprises a lamp inductor and a resonant capacitor; a preheating device that comprises the series connection of a primary inductor, a third electronic switch and a current measurement resistor that is coupled between the midpoint of the inverter and the second input connection, and a first secondary inductor and a second secondary inductor coupled to the primary inductor, wherein the first secondary inductor is coupled to the first output connection and the second secondary inductor is coupled to the second output connection; a control device that is coupled to the current measurement resistor in which at least two sets of operating parameters assigned to different types of discharge lamps are stored, wherein one set of operating parameters constitutes a current set of operating parameters, wherein the control device is designed to actuate at least the first, the second and the third electronic switch in accordance with the current set of operating parameters; wherein in the preheating phase a first value of the voltage drop correlated with the reciprocal of the electrical resistance of at least one coil of the at least one discharge lamp is determined across the current measurement resistor at a first instant, and a second value of the voltage drop correlated with the reciprocal of the electrical resistance of the at least one coil of the at least one discharge lamp is determined across the current measurement resistor at a second instant, wherein the second instant is after the first instant;

the method comprising:

a) determining the difference between the first value of the voltage drop and the second value of the voltage drop;

b) b1) if the difference is greater than a first threshold value: determining lamp-type;

b2) if the difference is not greater than the first threshold value:

c1) if the difference is greater than a second threshold value, wherein the second threshold value is less than the first threshold value:

d1) determining a coil short circuit is present if the second value is greater than a third threshold value of the voltage drop:

d2) operating the lamp with the current set of operating parameters if the second value is not greater than the third threshold value of the voltage drop.

2. The method as claimed in claim 1, further comprising:

c2) if the difference is less than the second threshold value:

d1) disabling lamp-type recognition if the second value of the voltage drop is between a fourth threshold value and a fifth threshold value, wherein the fifth threshold value is less than the fourth threshold value:

d2) determining a coil short circuit is present if the second value of the voltage drop is greater than the fourth threshold value:

d3) determining a dummy coil is present if the second value of the voltage drop is less than the fifth threshold value.

3. The method as claimed in claim 2, wherein the lamp-type recognition is enabled upon determination of the coil short circuit given disabled lamp-type recognition.

4. The method as claimed in claim 1, wherein a shutdown is carried out by the control device after determination of the coil short circuit.

5. The method as claimed in claim 1, wherein at least one of the first threshold value and the second threshold value is formed by the product of a factor "a" and the second value of the voltage drop, wherein $0<a<2$.

6. The method as claimed in claim 1, wherein the third threshold value is formed by the product of a factor "b" with the fourth threshold value, where $0<b<1$, wherein the fourth threshold value is greater than the second value of the voltage drop caused by the coil of least resistance, and the fifth threshold value is less than the fourth threshold value.

7. A circuit arrangement for operating at least one discharge lamp, the circuit arrangement comprising:

an input of a first and a second input connection for connecting a DC supply voltage;

an output with at least a first and a second output connection for connecting the at least one discharge lamp;

an inverter with at least a first and a second electronic switch that are coupled in series between the first and the second input connection, wherein a midpoint of the inverter is formed between the first and the second switch;

an ignition device that comprises a lamp inductor and a resonant capacitor;

a preheating device wherein that preheating device comprises the series connection of a primary inductor, a third electronic switch and a current measurement resistor that is coupled between the midpoint of the inverter and the second input connection, and a first secondary and a second secondary inductor coupled to the primary inductor, wherein the first secondary inductor is coupled to the first output connection and the second secondary inductor is coupled to the second output connection;

a control device that is coupled to the current measurement resistor in which at least two sets of operating parameters assigned to different types of discharge lamps are stored, wherein one set of operating parameters constitutes a current set of operating parameters, wherein the control device is designed to actuate at least the first electronic switch, the second electronic switch and the third electronic switch in accordance with the current set of operating parameters; wherein the control device is, furthermore, designed to determine in the preheating phase a first value of the voltage drop correlated with the electrical resistance of at least one coil of the at least one discharge lamp via the current measurement resistor at a first instant, and to determine a second value of the voltage drop correlated with the electrical resistance of the at least one coil of the at least one discharge lamp via the current measurement resistor at a second instant, wherein the second instant is after the first instant;

wherein the control device:

a) determines the difference between the first value of the voltage drop and the second value of the voltage drop;

b) b1) carries out lamp-type recognition if the difference is greater than a first threshold value;

b2) wherein if the difference is not greater than the first threshold value, and if the difference is greater than a second threshold value, wherein the second threshold value is less than the first threshold value:

d1) determines a coil short circuit is present if the second value of the voltage drop is greater than a third threshold value;

d2) operates the lamp with the current set of operating parameters if the second value of the voltage drop is not greater than the third threshold value.

* * * * *